US007182090B2

(12) United States Patent
Abbott

(10) Patent No.: US 7,182,090 B2
(45) Date of Patent: Feb. 27, 2007

(54) SYSTEM FOR CLEANING COMPONENTS OF A WATER RETAINING DEVICE, ASSOCIATED WATER RETAINING DEVICE, AND WATER PROPULSION DEVICE FOR USE THEREIN

(76) Inventor: W. T. David Abbott, 1035 Lakepointe Dr., Forest, VA (US) 24551

( * ) Notice: Subject to any disclaimer, the term of this patent is extended or adjusted under 35 U.S.C. 154(b) by 425 days.

(21) Appl. No.: 10/873,093

(22) Filed: Jun. 21, 2004

(65) Prior Publication Data

US 2005/0199275 A1 Sep. 15, 2005

Related U.S. Application Data

(63) Continuation-in-part of application No. 10/798,582, filed on Mar. 10, 2004.

(51) Int. Cl.
*B08B 3/04* (2006.01)

(52) U.S. Cl. ..... 134/166 C; 134/169 C; 239/581.1; 4/490

(58) Field of Classification Search ..... 134/166 C, 134/169 C; 4/490, 541; 239/581.1, 587.1
See application file for complete search history.

(56) References Cited

U.S. PATENT DOCUMENTS 4,856,125 A 8/1989 Dijkhuizen
4,901,926 A 2/1990 Klotzbach
4,979,245 A * 12/1990 Gandini ..... 4/541.4
5,012,535 A 5/1991 Klotzbach
5,032,292 A * 7/1991 Conrad ..... 210/764
5,109,880 A * 5/1992 Booth ..... 134/108
5,368,651 A * 11/1994 Esser ..... 134/22.1
5,694,957 A * 12/1997 Lee, Jr. ..... 134/169 C
5,810,262 A * 9/1998 Ton ..... 239/428.5
5,862,543 A * 1/1999 Reynoso et al. ..... 4/541.6
5,862,545 A 1/1999 Mathis et al.
5,920,925 A * 7/1999 Dongo ..... 4/541.6
6,123,274 A * 9/2000 Perdreau et al. ..... 239/581.1
6,199,224 B1 3/2001 Versland
6,279,177 B1 * 8/2001 Gloodt ..... 4/541.1
6,322,004 B1 * 11/2001 Perdreau et al. ..... 239/428.5
6,491,238 B1 * 12/2002 Swanson et al. ..... 239/587.4
6,848,637 B2 * 2/2005 Holtsnider ..... 239/587.1
2001/0027573 A1 * 10/2001 Gloodt ..... 4/541.1

OTHER PUBLICATIONS

Euorpean Patent Office 0 312 953 Oct. 1988.*

* cited by examiner

*Primary Examiner*—Frankie L. Stinson
(74) *Attorney, Agent, or Firm*—Kevin P. Crosby; Daniel C. Crilly; Brinkley, Morgan et al.

(57) ABSTRACT

A system for cleaning components of one or more water retaining devices (e.g., tubs) includes two pumps, a tank, one or more supply valves, a water retaining device, and control circuitry. The pumps control the flow of a concentrated cleaning agent and water to the tank. The tank stores the cleaning agent and water as a diluted cleaning solution at a desired pressure, and selectively dispenses the diluted solution to the tub(s) through appropriate piping. The supply valve(s) controls the flow of cleaning solution to components of the tub. The tub includes a water propulsion device (e.g., jet) configured to facilitate efficient cleaning of the propulsion device's various surfaces. The control circuitry controls the operation of the pumps and preferably the supply valve(s) in accordance with a predetermined cleaning procedure. The system may optionally include an outflow device to prevent premature evacuation of the cleaning solution from the tub's components.

21 Claims, 8 Drawing Sheets

200

150
138
141
CONTROL SYSTEM
109
203
245
108
144
106
133
131
134
123
122
121
120
129
107
126
PUMP
125
136
143
128
119
118
117
OUTFLOW DEVICE
111
124
SUCTION
127
104
140
TANK
SWITCH
FROM POTABLE WATER SUPPLY
PUMP
102
202
MOTOR
115
204
RESERVOIR
201
PUMP
113

SYSTEM FOR CLEANING COMPONENTS OF A WATER RETAINING DEVICE, ASSOCIATED WATER RETAINING DEVICE, AND WATER PROPULSION DEVICE FOR USE THEREIN

CROSS-REFERENCE TO RELATED APPLICATIONS

This application is a continuation-in-part of co-pending U.S. patent application Ser. No. 10/798,582 filed Mar. 10, 2004 still pending and hereby claims priority upon such co-pending application under 35 U.S.C. § 120.

FIELD OF THE INVENTION

The present invention relates generally to spas, hot tubs, whirlpool tubs, pools and other water retaining devices in which humans immerse themselves to bathe, relax, receive therapy or treatment, or exercise. More particularly, the present invention relates to a system for cleaning one or more such water retaining devices so as to sanitize and/or disinfect both air and water components of such devices without requiring the use of potentially harmful cleaning agents, such as ozone, or the local, manual insertion of a cleaning agent or solution into each device. The present invention further relates to a water retaining device to be so cleaned and a water propulsion device (e.g., a water and air jet) for use in such a water retaining device.

BACKGROUND OF THE INVENTION

Hydro-massage tubs, such as hot tubs, whirlpool tubs, physical therapy tubs, and spas, are well known. Such devices typically include a tub structure with a water circuit and/or an air circuit and one or more nozzles or jets that direct a flow of pressurized water and/or air into the interior of the tub. In these types of water retaining devices, a suction opening in the tub removes bath water from the interior of the tub and provides the water to a water pump that pressurizes the water and returns the pressurized water through the water circuit to the nozzles that open into the interior of the tub. The air circuit is typically provided to mix air with the water to provide a water and air mixture from each nozzle.

The water circuit of the hydro-massage tub includes the water pump and various pipes that convey water from the suction opening in the bath tub through the pump in such a way that the water removed from the tub is pressurized before it is returned to the nozzles in the wall of the tub. In a similar manner, the air circuit includes pipes used to convey air from an adjustable air vent or air blower to the nozzles, where the air may be either mixed with the water just before the water exits the nozzles and re-enters the tub or separately injected into the water of the tub.

The inner walls of the pipes in both the water circuit and the air circuit are susceptible to the accumulation of, inter alia, fatty deposits and calcium deposits. The air circuit is subject to such undesired deposits because it becomes filled with water when the tub is filled with water and the water pump is turned off. The growth of bacteria in connection with these deposits is a particular problem when there are many different users of the tub, such as is the case in hotels, hospitals, and other institutions. Due to the potential for bacteria build-up in the tub's piping, regular cleaning of the tub is required.

Conventional cleaning methodologies require the user or other individual delegated the task of cleaning the tub (e.g., a housekeeper in a hotel) to fill the tub with hot water to a level just above the highest water or air jet, pour in a cleaning agent, and then run the tub system so that the water and cleaning agent are conducted through the various pipes in the system. If stronger cleaning agents or chemicals are used, the user must typically empty the tub after cleaning has been completed, refill the tub, and then run the system once more to rinse away the cleaning agent and/or chemical residues. As evident from the foregoing, conventional tub cleaning wastes a significant amount of water and requires substantial time to complete. Further, some of the common, strong cleaning agents, such as ozone, can have harmful effects on the individuals that perform the tub cleaning. Still further, with conventional tub cleaning approaches, an unnecessarily large amount of cleaning agent has to be used in order to reach an adequate cleaning solution concentration when the tub is full of water.

Various tub cleaning techniques have been proposed to substantially reduce the amount of water, cleaning agent and time necessary to clean a hydro-massage tub. Such techniques are described in U.S. Pat. No. 6,199,224 to Versland, U.S. Pat. No. 5,862,545 to Mathis et al., U.S. Pat. Nos. 5,012,535 and 4,901,926 to Klotzbach, and U.S. Pat. No. 4,856,125 to Dijkhuizen. However, all these techniques require the introduction of a cleaning agent into the water piping of the tub through a local dispenser. Thus, such techniques require the user or other individual performing the tub cleaning to manually add the cleaning agent to the tub's dispenser at the time of cleaning. As a result, all such prior art techniques are labor intensive.

Therefore, a need exists for a system for cleaning a water retaining device, such as a pool or a hydro-massage tub, that mitigates the amount of water, cleaning agent and time necessary to perform the cleaning, while eliminating the need for manual, local insertion of the cleaning agent into the device. A water retaining device for use in or with such a system and a water propulsion device for use in or with such a water retaining device would also be an improvement over the prior art.

DETAILED DESCRIPTION OF PREFERRED EMBODIMENTS

Figure 1:
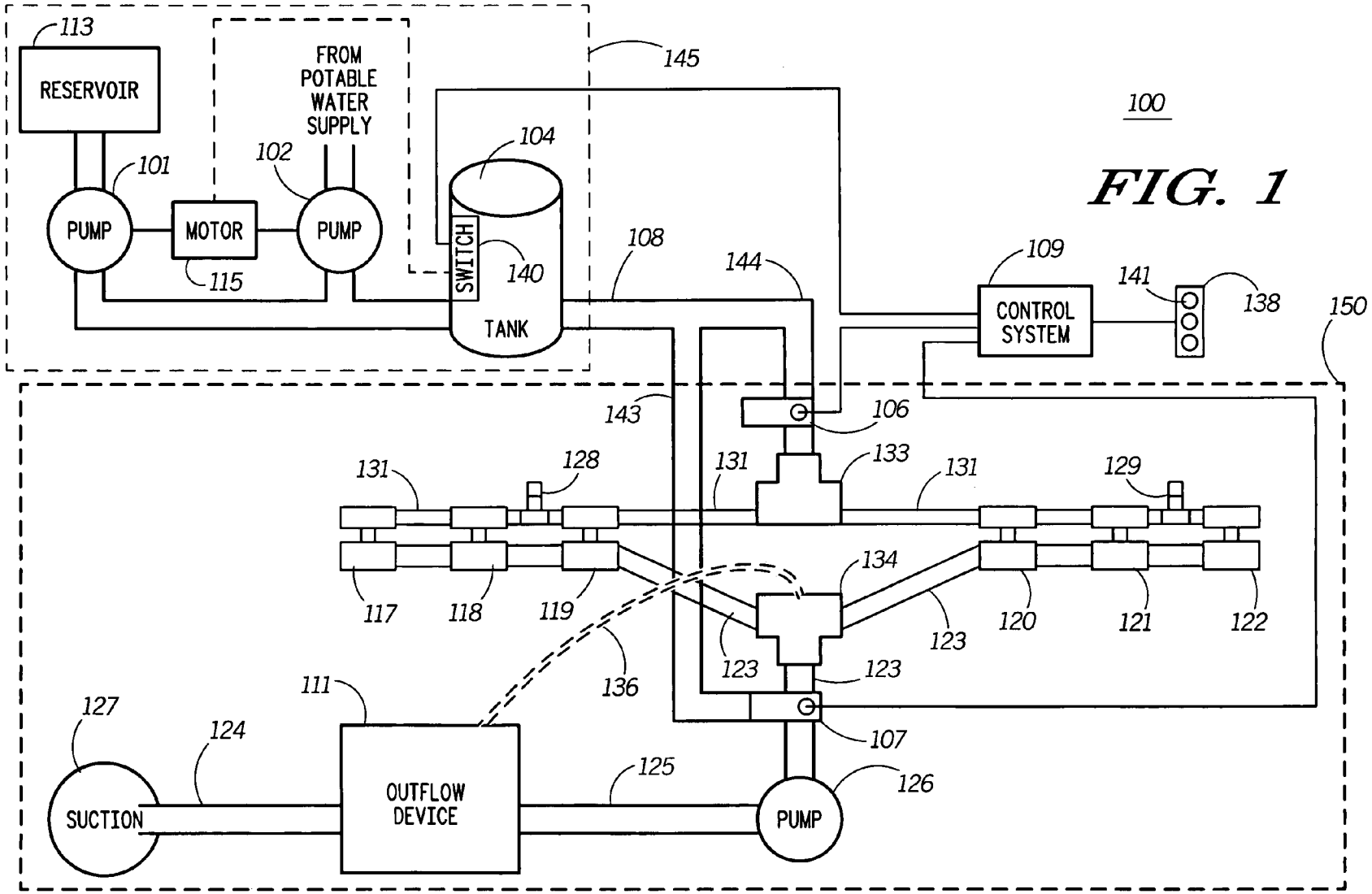
FIG. 1 is a block diagram of a water retaining device and its associated cleaning system in accordance with a first embodiment of the present invention.

Generally, the present invention encompasses a system for cleaning components of one or more water retaining devices, such as hydro-massage tubs (e.g., spas, hot tubs, physical therapy tubs, or whirlpool tubs) or pools. The preferred system includes, inter alia, two pumps, a tank, one or more supply valves, control circuitry, and at least one water retaining device that includes a water propulsion device (e.g., jet) configured to facilitate efficient cleaning of the propulsion device's interior surfaces. The pumps control the flow of a concentrated cleaning agent and water to the tank. The tank stores the cleaning agent and water to produce a diluted cleaning solution, preferably maintains a desired range of operating pressure in the system, and selectively dispenses the diluted solution to the water retaining device (s) through appropriate piping. The supply valves control the flow of diluted cleaning solution to the wetted components (e.g., air system components and/or water system components) of the water retaining device(s). The control circuitry controls the operation of the pumps and the supply valve(s) in accordance with a predetermined procedure for cleaning the water retaining device(s).

The water propulsion device includes at least a face or cover, a body, and a cleaning solution inlet. The cover includes a recessed interior surface terminating in a base. The cover's base defines one or more apertures around a periphery thereof and further defines a water supply aperture positioned in a central portion of the base.

The body of the water propulsion device includes a recessed interior surface that accommodates an exterior surface of the cover when the body and the cover are mated together in an inter-fitting relation. The body terminates in a base that defines a water supply aperture positioned in a central portion of the body's base and aligned substantially with the water supply aperture in the base of the cover when the body and the cover are mated together. The base of the body also defines an inlet aperture to facilitate a flow of cleaning solution to surfaces of the cover and the body and to the aperture(s) in the periphery of the cover's base to facilitate cleaning of at least interior and exterior surfaces of the cover and the interior surface of the body.

The cleaning solution inlet is connected to an exterior surface of the base of the body and defines an aperture to facilitate the flow of cleaning solution from a source of the cleaning solution to the inlet aperture in the base of the body. The inlet is positioned on the exterior surface of the base of the body such that the aperture of the inlet substantially aligns with the inlet aperture in the base of the body. The inlet is preferably formed (e.g., through use of molding techniques) as an integral part of the exterior surface of the base of the body. The inlet and the inlet aperture of the body permit the cleaning solution introduced into the air system piping/tubing to flow onto and substantially cover the surfaces of the water propulsion device that are subject to bacterial contamination as a result of the normal use of the water retaining device.

By providing a cleaning system in this manner, the present invention provides a mechanism for automatically and rapidly cleaning one water retaining device, such as may be implemented in a personal residence, or several water retaining devices, such as may be embodied in a hotel, nursing home, hospital, or elsewhere, without requiring the use of potentially hazardous cleaning agents, such as ozone, or manual addition of the cleaning agent in each individual device. In addition, the cleaning system and method of the present invention substantially reduce the amount of cleaning agent and water normally required for cleaning and disinfecting jetted water retaining devices. Further, the water propulsion device disclosed herein permits the cleaning solution to contact and/or cover all or substantially all the components of the water propulsion device that are subject to bacterial contamination resulting from normal use of the water retaining device.

The present invention can be more fully understood with reference to FIGS. 1–10, in which like reference numerals designate like items. FIG. 1 is a block diagram of a water retaining device 150 and its associated cleaning system 100 in accordance with a first embodiment of the present invention. The water retaining device 150 is preferably a device of the type that includes a tub having nozzles or jets that introduce or inject water, air, or a water and air mixture into the tub and further having at least one suction opening through which water is removed from the tub and pressurized through a pump for reintroduction into the tub via the nozzles or jets. As a result, the water retaining device 150 is preferably a spa, hot tub, whirlpool tub, physical therapy tub, or any other type of hydro-massage tub or bath. Alternatively, the water retaining device 150 may be a swimming pool or similar device.

The cleaning system 100 includes one or more pumps 101, 102 (two shown), a pressure tank 104 coupled to the outputs of the pumps 101, 102, one or more supply valves 106, 107 (two shown) coupled between the tank 104 and the components of the water retaining device 150 that are to be cleaned, tubing or piping 108, 143, 144 connecting the tank 104 to the supply valves 106, 107, and a control system 109 that includes at least some of the control circuitry utilized to control operation of the pumps 101, 102 and the supply valves 106, 107 in accordance with a procedure for cleaning the components of the water retaining device 150. In a preferred embodiment, the cleaning system 100 further includes at least one outflow device 111 for controlling a flow of cleaning solution out of the components of the water retaining device 150 in accordance with the cleaning procedure, a reservoir 113 or other storage device for retaining a concentrated cleaning solution or agent to be used in the cleaning process, and an induction or other appropriate motor 115 to drive the pumps 101, 102. The pumps 101, 102, the tank 104, the reservoir 113, and the motor 115 collectively form a cleaning solution subsystem 145 of the cleaning system 100. The cleaning system 100 may include other elements as described in more detail below.

The water retaining device 150 preferably comprises a hydro-massage tub and includes a water subsystem and/or an air subsystem (both subsystems being depicted in FIG. 1). In accordance with the present invention, the water retaining device 150 also preferably includes the supply valves 106, 107 and the outflow device 111. Thus, some of the components of the water retaining device 150 form part of the cleaning system 100, and vice versa.

Components of the water retaining device's water subsystem preferably include a plurality of water jets 117–122 (six shown), water return tubing 124, 125, a water system pump 126, and at least one suction opening 127 (one shown) through which water in the tub 150 is removed by the water system pump 126 and reintroduced into the tub 150 via the water jets 117–122 in accordance with conventional techniques. Components of the water retaining device's air subsystem preferably include a plurality of air jets integral to the water jets 117–122, air intakes that preferably include corresponding check valves 128, 129 (two shown), air line tubing 131, and an air system pump or blower (not shown). Tee fittings 133, 134 and a pressure line or tube 136 may also be included within the tub plumbing as part of the cleaning system 100 to control the flow of cleaning solution to the components of the water and/or air subsystems, and to control the operation of the outflow device 111, when used, as described in more detail below. As illustrated, components of the air and water subsystems preferably interact to inject air into the water expelled from the water jets 117–122 to enhance the massaging action of the injected water in accordance with known techniques. Alternatively, the air subsystem components may inject air directly into the water resident in the tub to obtain a bubbling or other effect. The water and air jets 117–122, 128, 129 are depicted in FIG. 1 as being positioned collinearly; however, one of ordinary skill in the art will readily appreciate that such jets 117–122, 128, 129 are preferably positioned at various locations around and throughout the tub as may be necessary to achieve a desired therapeutic result.

The control system 109 includes conventional integrated circuits, logic circuits, software, microprocessors, transformers, activators, fuses, relays, and other elements arranged to control the operation of the pumps 101, 102, the tank 104 and the supply valves 106 in accordance with a desired cleaning procedure as described herein. In the preferred embodiment, the control system 109 also includes a mass sensor (not shown) to detect when a substantial volume of water has been used in the water retaining device 150 (e.g., a whirlpool tub in a hotel room) and a control panel 138 containing light emitting diodes (LEDs) or other visual indicators to inform the cleaning system user when a water retaining device 150 is in need of cleaning. Still further, the control system 109 preferably includes a conventional pressure sensing device and/or switch 140 resident in the tank 104 to determine the air pressure in the tank and optionally control the operation of the pumps 101, 102 and/or their motor(s) 115 in response to the detected pressure, as described in more detail below.

The reservoir 113 preferably comprises a plastic, metal or other storage device that is centrally located and filled with a non-hazardous, concentrated cleaning solution or agent, such as anti-bacterial soap or bleach. Pump 101 is coupled either directly or via appropriate plumbing to the output of the reservoir 113. Pump 102 is coupled via appropriate plumbing to a potable water supply (not shown). Pumps 101 and 102 are preferably metering pumps or constant volume, non-slip pumps and are preferably driven by a single induction motor 115, although separate motors may be alternatively used. Alternatively, pumps 101 and 102 may be positive displacement pumps or any other type of hydro pump.

The tank 104 preferably comprises a plastic or metal, diaphragm or bladder pressure tank having a volume sufficient to hold an amount of diluted cleaning solution (cleaning agent and water) adequate to clean one or more water retaining devices 150 that are coupled to the tank 104. The tank 104 also serves to maintain a desired system pressure due to potable water system pressure variations that normally occur depending on the geographical location of the water retaining device 150 and the time of day. System pressure may be alternatively maintained by elevating the tank 104 a predetermined distance above the water retaining device(s) 150, wherein such distance is determined based on the desired system pressure in accordance with conventional techniques. Further, because the tank 104 is used to retain a desired volume of cleaning solution and to maintain a desired system pressure during the cleaning cycle, the preferred pressurized tank 104 may be replaced with a non-pressurized tank and a pressure pump, wherein the tank would be used merely for storing the cleaning solution and the pressurized pump would be used to extract the cleaning solution from the tank and to pressurize the system during the cleaning cycle. Still further, the water pump 102 and the preferably pressurized tank 104 may be replaced with a pressure pump, a flow meter and an injector to introduce the cleaning agent into the pressurized flow of water from the pressure pump.

The supply valves 106, 107 preferably comprise diaphragm, plug, gate, ball, or any other types of valves that are operated or controlled electrically (e.g., solenoid controlled valves), hydraulically, mechanically (e.g., spring-controlled valves) or pneumatically. When used, the outflow device 111 preferably comprises a hydraulically controlled valve, such as a self-draining diaphragm valve as described in detail in commonly assigned U.S. Pat. No. 6,688,577 B2 entitled "Self Draining Valve", which patent is incorporated herein by this reference. Alternatively, the outflow device 111 may comprise a diaphragm, plug, gate, or ball valve, an electrically controlled valve, such as a solenoid valve or a motorized valve, a mechanically controlled valve, such as a spring-controlled valve, or a pneumatically controlled valve. Still further, the outflow device 111 may be any other controllable device that retards or stops the flow of cleaning solution out of the air and water subsystem components of the water retaining device 150 while the cleaning solution is being injected into the air and water subsystem components of the device 150. One such alternative outflow device 111 is a valve disc as described in U.S. Pat. No. 5,862,545, which patent is incorporated herein by this reference. Another alternative outflow device 111 is described in more detail below with respect to FIGS. 3 and 4.

The outflow device 111 can be slower acting than the supply valves 106, 107 because the cleaning solution will take time (e.g., a few seconds) to reach the suction output 127 of the water retaining device 150 after the solution is injected into the components of the water retaining device 150 by the supply valves 106, 107. That is, when used, the outflow device 111 may control the flow of cleaning solution out of the components of the water retaining device 150 at a rate that is slower than the rate at which the supply valve(s) 106, 107 control the flow of cleaning solution into the air and/or water subsystem components of the water retaining device 150.

Figure 3:
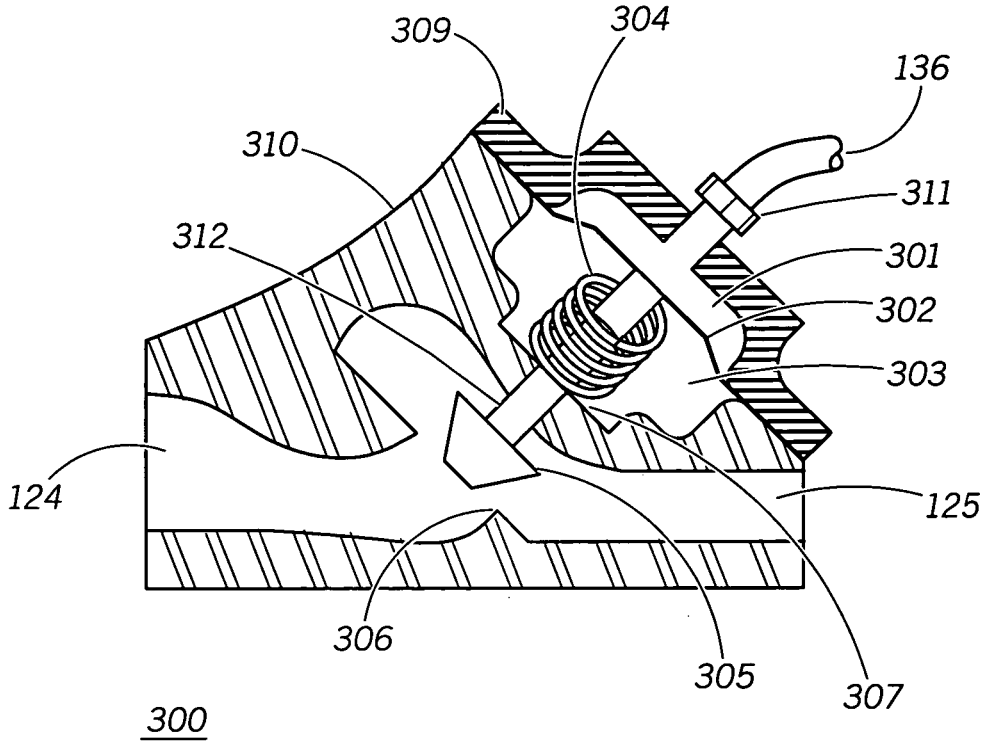
FIG. 3 is a partial, cut-away side view of an outflow device in an open position for use in a water retaining device and/or cleaning system in accordance with one embodiment of the present invention.
Figure 4:
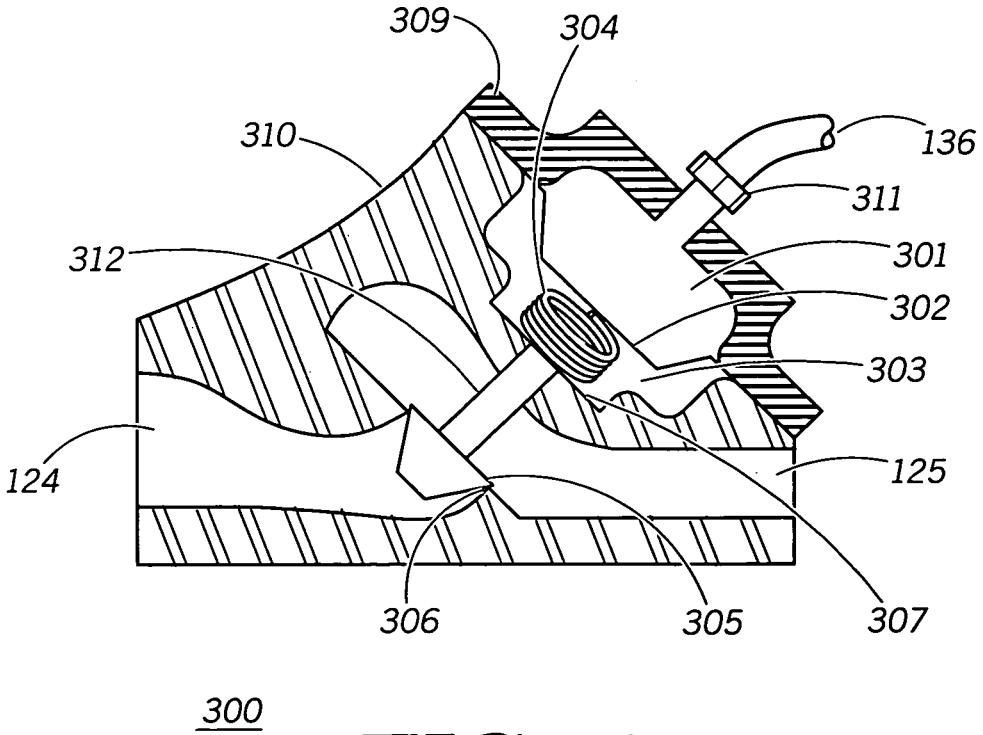
FIG. 4 is a partial, cut-away side view of the outflow device of FIG. 3 in a closed position.

The cleaning system's and water retaining device's tubing, plumbing and associated fittings 108, 123–125, 131, 133, 134, 136, 143, 144 are preferably conventional PVC components adapted as necessary to implement the present invention, although other appropriate plumbing materials may be used. For example, when a spring return plug valve, as described in detail below with respect to FIGS. 3 and 4, is utilized to implement the outflow device 111, T-fitting 134 is preferably modified to include an aperture and fitting to accommodate attachment of a fluid supply pressure tube 136 for use by the spring return plug valve. The water retaining device's air and water jets 117–122, 128, 129 are conventional jets, nozzles and/or check valves, as applicable, used in the production of hydro-massage tubs, pools, or other water retaining devices that facilitate the use of propelled water and/or air within such device(s). Alternatively, the water retaining device's air and water jets 117–122, 128, 129 may be configured to facilitate cleaning of all or substantially all the interior surfaces of the jets 117–122, 128, 129 as detailed below with respect to FIGS. 7–10.

Operation of the cleaning system 100 occurs substantially as follows in accordance with the first embodiment of the present invention. A user of the system 100 fills the reservoir 113 with a preferably non-hazardous, concentrated cleaning agent, such as antibacterial, non-bubbling soap or bleach. After the cleaning agent has been added to the reservoir 113 and the access door (not shown) has been closed, the control system 109 determines whether the tank 104 needs to be filled or recharged and, if so, activates the motor 115 causing the pumps 101, 102 to pump the concentrated cleaning agent and fresh water into the tank 104 and its output piping 108, 143, 144 (if not already filled). The two pumps 101, 102 are preferably variable and are configured so as to provide the tank 104 a predetermined ratio of cleaning agent to water depending upon the strength of the final diluted solution as desired by the system user. For example, the pump 101 coupled to the cleaning agent reservoir 113 may pump at a rate that is $1/64^{th}$ the rate at which the pump 102 coupled to the potable water supply pumps to achieve a desired dilution of sixty-four (64) parts water per one part concentrated cleaning agent.

The cleaning agent and water are pumped into the tank 104 until the pressure switch 140 located within the tank 104 detects that the pressure within the tank 104 has reached a predetermined upper threshold indicating that the tank 104 is sufficiently full of the diluted cleaning solution. Once the predetermined upper pressure is detected, the pressure switch 140 outputs a signal (e.g., voltage level) to the control system 109 to indicate that the desired tank pressure has been attained. The control system 109 then outputs a signal to the pump motor 115 via a control line to deactivate the pump motor 115. Alternatively, the pressure switch 140 may output its signal directly to the pump motor 115 to de-activate the pump motor 115, thereby stopping the flow of cleaning agent and water into the tank 104. The tank 104 stores the diluted cleaning solution until such time as cleaning is desired.

When cleaning is desired, the user operates the control system 109 to automatically perform the cleaning. Alternatively, the control system 109 may begin an automatic cleaning cycle at preset cleaning times through use of an appropriate timer. Operating in accordance with a desired cleaning procedure (e.g., stored in control system memory and executed by an appropriate control system microprocessor, or hard-coded into the control system logic), the control system 109 sends appropriate signals to the supply valves 106, 107, either directly or indirectly through applicable components, such as pneumatic pumps or solenoids, causing the supply valves 106, 107 to open and causing the tank 104 to selectively dispense some or all of its contents into the piping 108, 143, 144 connecting the tank 104 to the supply valves 106, 107. The emptying of the tank 104 causes the pressure in the tank 104 to rapidly decrease. The in-tank pressure switch 140 (an ancillary part of the control system 109) detects the decrease in tank pressure and provides an indication of such decrease in pressure to the control system 109 when the tank pressure drops below a second predetermined or lower threshold.

Upon detecting the indication from the tank pressure switch 140 and otherwise completing the cleaning cycle (e.g., by closing the supply valves 106, 107), the control system 109 activates the pump motor 115 causing the pumps 101, 102 to refill and recharge the tank 104. Should the control system 109 receive a cleaning request during the tank's recharging cycle, the control system 109 preferably queues the request (e.g., in a first-in, first-out (FIFO) queue) and initiates a cleaning cycle to respond to the request upon completion of the tank's recharging cycle (e.g., as provided by the output of the pressure switch 140 indicating that the tank pressure has been restored to its desired upper level). The pressure threshold selected to activate the pump motor 115 and recharge the tank 104 is preferably substantially less than the pressure threshold selected to de-activate the pump motor 115. For example, the pressure threshold for activating (turning on) the pump motor 115 may be only sixty (60) pounds per square inch (psi); whereas, the pressure threshold for de-activating (turning off) the pump motor 115 may be seventy-five (75) psi in the event that the tank 104 is located on the same floor or level as the water retaining device 150. If the tank 104 is located below the water retaining device 150, the pressure threshold for de-activating (turning off) the pump motor 115 may be considerably higher (e.g., 90 psi).

Once the cleaning cycle has been initiated, the diluted cleaning solution rapidly flows from the tank 104 to the wetted components of the air and water subsystems of the water retaining device 150. The amount of cleaning solution released from the tank 104 is preferably the minimum amount necessary to wet the air and water subsystem components of the water retaining device 150. The supply valves 106, 107 remain open for a period of time sufficient to allow a predetermined quantity of cleaning solution to enter the air and water subsystems of the water retaining device 150. When the cleaning system 100 is configured to clean a single water retaining device 150, the predetermined quantity of cleaning solution released from the tank 104 may comprise substantially all the cleaning solution stored in the tank 104. The amount of time that the supply valves 106, 107 remain open is a function of the size of the water retaining device 150, the number of air and/or water jets 117–122, 128, 129, and whether or not the water retaining device 150 includes an outflow device 111. When an outflow device 111 is used, the air and/or water jets 117–122, 128, 129 are preferably kept open during the cleaning process to allow the cleaning solution to wet the walls, seats and floor of the water retaining device 150.

As briefly mentioned above, the outflow device 111, when included, prevents the cleaning solution from exiting the piping 123, 125, 131 of the water retaining device 150, thereby eliminating the need to close the jets, suction, orifices, and other outflow openings of the water retaining device 150. Use of the outflow device 111 also minimizes the amount of cleaning solution used and the time required to wet the air and/or water subsystem components of the water retaining device 150. In the preferred embodiment, the outflow device 111 is a self-draining diaphragm valve positioned between the water retaining device's suction opening 127 and the water pump 126, such that the outflow device 111 is capable of stopping the flow of cleaning solution to the suction side of the water return tubing 124. The outflow device 111 is normally open during non-cleaning periods to allow normal water flow from the suction opening 127 to the water pump 126 through the water return tubing 124, 125. With the water return line 124, 125 interrupted by the outflow device 111 during the cleaning cycle, the cleaning solution can fill the piping, tubing, jets, heaters and other components of the tub's water and/or air subsystems, wetting their surfaces. Closing the outflow device 111 also assists in minimizing both the amount of time and the quantity of diluted cleaning solution necessary to completely wet the components of the water retaining device 150 because the solution is not permitted to exit the water retaining device components so long as the outflow device 111 is closed.

After all or substantially all of the components of the water retaining device 111 have been wetted, the control system 109 may be optionally programmed to rinse the air and water subsystems of the water retaining device 150. In a preferred embodiment, rinsing does not form part of the cleaning process because the retention of residual cleaning solution in the piping/tubing and jet pockets of the water retaining device 150 is desirable to enable the disinfectant cleaning solution to control or eliminate the growth of potentially harmful bacteria in such locations during periods of non-use of the water retaining device 150. If rinsing is desired, a second set of controllable supply valves (e.g., solenoid controlled valves), similar to valves 106 and 107, would be preferably incorporated into the piping of the water retaining device 150 and coupled to the hot water supply line (not shown) to facilitate injection of clean hot water into the water retaining device 150 for purposes of rinsing the cleaning solution from the water retaining device's components.

A control panel 138 for the control system 109 is preferably located in a central location, such as the domestic closet or front desk of a hotel. The panel 138 preferably includes lights or LEDs 141 to inform the housekeeping supervisor or other user of the cleaning system 100 as to which water retaining devices 150 need to be cleaned. The control system 109 preferably includes mass sensors to detect the flow of water to the water retaining device 150 (e.g., a whirlpool tub) or other appropriate sensors to detect that the water retaining device 150 has been used (e.g., current or voltage sensors to determine when the water pump or air blower of the device 150, such as a spa or pool, is operated). When the control system 109 determines that the water retaining device 150 has been used, an LED 141 on the control panel 138 may be lit to inform the system user that the device 150 needs to be cleaned.

Alternatively, a control panel 138 may be located in each room containing a water retaining device 150. In this case, the housekeeping staff or other user of the cleaning system 100 can determine, based on which LED(s) 141 of the control panel 138 is lit, whether tub cleaning is necessary. In addition, in this embodiment, the control panel 138 may include a key switch or comparable device (not shown) to enable the cleaning system user to activate the cleaning system 100 from the room containing the water retaining device 150 that needs cleaning. In such a case, the key switch would activate or de-activate, depending on switch position, logic in the control system 109 to enable or disable the cleaning procedure for the particular water retaining device 150.

In an alternative embodiment, the two pumps 101, 102 and the tank 104 may be replaced by a single pump 101 coupled by appropriate pipes between the reservoir 113 and the supply valves 106, 107. In this case, a pre-diluted cleaning solution is stored in the reservoir 113. When cleaning is desired, the control system 109 activates the pump 101 for a predetermined period of time sufficient to transfer a desired volume of cleaning solution through the opened supply valves 106, 107.

Figure 2:
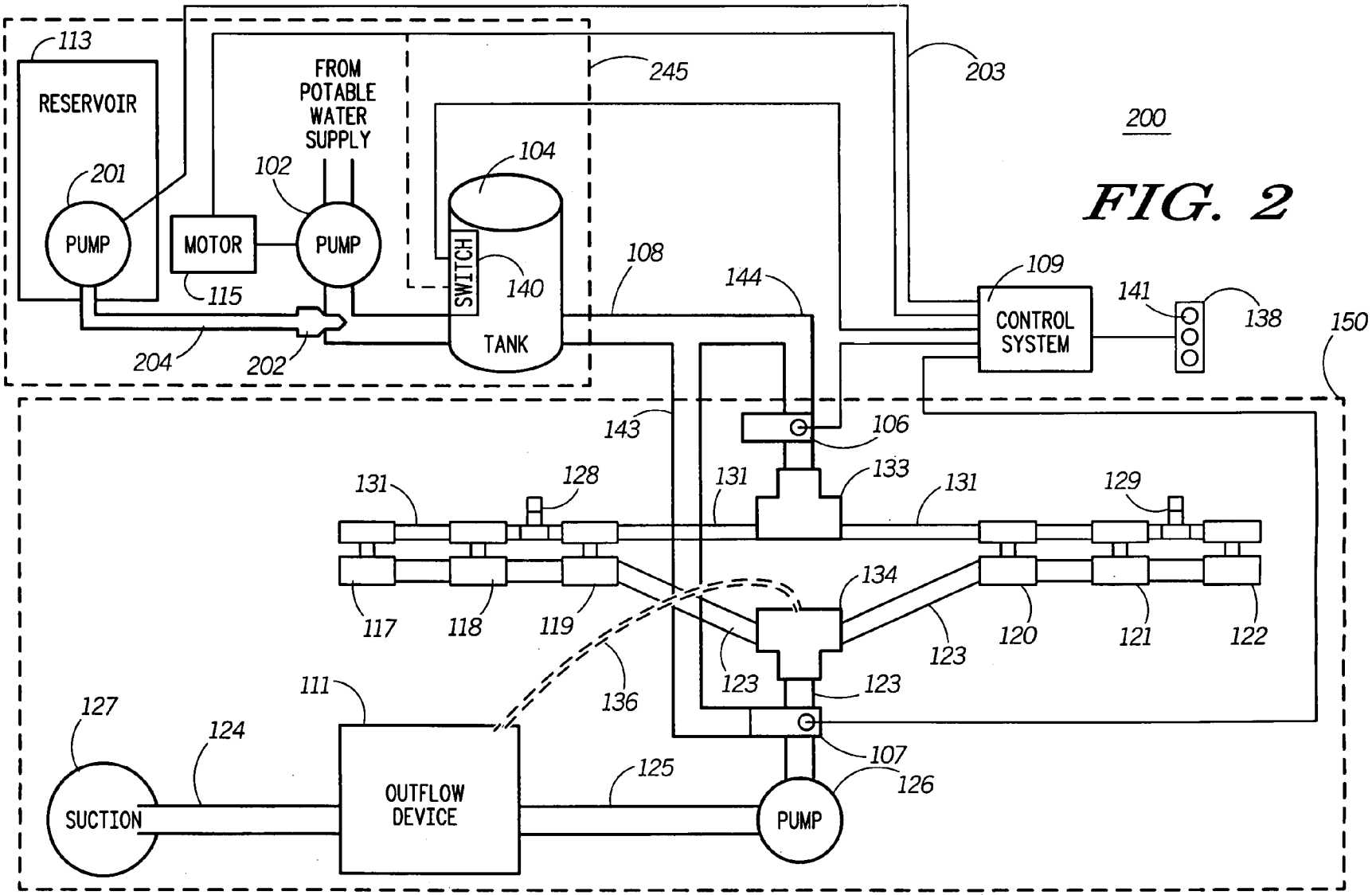
FIG. 2 is a block diagram of a water retaining device and its associated cleaning system in accordance with a second embodiment of the present invention.

FIG. 2 is a block diagram of a water retaining device 150 and its associated cleaning system 200 in accordance with a second embodiment of the present invention. The only difference between the cleaning system 200 of FIG. 2 and the cleaning system 100 of FIG. 1 is in the implementation of the cleaning solution subsystem 145, 245. In the embodiment of FIG. 2, the cleaning solution subsystem 245 includes a cleaning agent pump 201 resident preferably inside the reservoir 113, an injector 202, a hose 204, the motor 115, the water pump 102, and the tank 104. Pump 201 preferably comprises a commercially-available automotive fuel pump or another similarly functioning in-tank pump operating under the control of the control system 109 based on a voltage supplied over control line 203. Alternatively, pump 201 may comprise a centrifugal pump. The injector 202 preferably comprises a commercially-available automotive fuel injector. The hose 204 preferably comprises a conventional rubber or other hose capable of withstanding at least 120 psi output from pump 201.

The operation of the cleaning system 200 of FIG. 2 is substantially identical to the operation of the cleaning system 100 described above with respect to FIG. 1, except for the below-described operation of the cleaning solution subsystem 245. As noted above with respect to FIG. 1, the reservoir 113 is filled with a concentrated cleaning solution or agent to a desired level depending on, inter alia, the quantity of water retaining devices 150 to be cleaned. When the pressure switch 140 detects that the pressure in the tank 104 has dropped or is below the low pressure threshold, the control system 109 closes the supply valves 106, 107 and activates pump 201 and motor 115 via respective control lines to begin recharging the tank 104. If a cleaning operation is in process when the low tank pressure condition is detected, the control system 109 preferably permits the cleaning cycle to complete before closing the supply valves 106, 107 and commencing the tank's recharging cycle. Once the tank's recharging cycle commences, the control system 109 prohibits any cleaning cycles to begin until the tank pressure rises to the desired upper threshold level.

To recharge the tank 104, the control system 109 first activates the water pump motor 115 to begin the flow of clean water into the tank 104. Shortly after the water pump motor has been turned on, the control system activates the in-tank pump 201. The in-tank pump 201 supplies concentrated cleaning or disinfectant solution from the reservoir 113 into the flow of clean water emanating from the water pump 102 via the injector 204. The control system 109 is preferably preprogrammed with the volume of the tank 104 and the desired cleaning solution dilution. Based on such information and the difference between the upper in-tank pressure threshold and the lower in-tank pressure threshold, the control system 109 maintains activation of pump 201 for a period of time that has been calculated to result in the appropriate amount of concentrated cleaning solution being injected into the clean water supply given the calculated volume required to fill the tank 104 and achieve a pressure within the tank 104 that is at least equal to the upper pressure threshold (e.g., 75–90 psi).

The combination of the water emanating from the water pump 102 and the concentrated cleaning solution emanating from the injector 202 is stored as a diluted cleaning solution in the tank 104. The control system 109 maintains activation of the water pump motor 115 and pump 201 until the tank's pressure switch 140 detects the desired level of tank pressure based upon the parameters of the cleaning system 200 (e.g., the number of water retaining devices 150 to be cleaned, the amount of piping to be pressurized by the tank 104 upon activation of the cleaning cycle, and so forth). Once the tank pressure has reached is desired level, the control system 109 permits one or more new cleaning cycles to begin. Once a cleaning cycle is activated, some or all of the pressurized tank contents are emptied into the tank's output piping 108 and thereafter into the branch piping 143, 144 for the water and/or air subsystem supply valves 106, 107. The remainder of the cleaning process is as described above with respect to FIG. 1.

As described above, the present invention provides a cleaning system for a water retaining device and a water retaining device configured for use in such a cleaning system. The cleaning system is arranged to provide for remote storage of a cleaning agent and automatic introduction of a cleaning solution into the air and/or water subsystem components of the water retaining device, thereby eliminating the need for manual insertion of the concentrated cleaning agent or diluted cleaning solution into the device locally, in sharp contrast to prior art cleaning methodologies. By directly injecting the cleaning solution into the air and/or water subsystems of the water retaining device, the present invention mitigates the amount of water and cleaning agent required to clean the system. In addition, in a preferred embodiment, the cleaning system of the present invention facilitates manual input of small quantities of concentrated cleaning agent, rather than large volumes of diluted cleaning solution, into the system's reservoir, thereby mitigating the amount of labor associated with operating the cleaning system. Further, through its automated operation, the present invention mitigates the time necessary to perform the cleaning procedure. Still further, the present invention facilitates both automatic, timed cleaning of the water retaining device and/or manual activation of the cleaning system from the room containing the water retaining device. Further yet, when rinsing is not utilized, cleaning solution remaining in the piping helps to control or eliminate the growth of potentially harmful bacteria during the time periods between uses of the water retaining device.

FIGS. 3 and 4 illustrate a partial, cut-away side view of an exemplary embodiment 300 of an outflow device 111 utilized in the cleaning systems 100, 200 and water retaining devices 150 depicted in FIGS. 1 and 2. The outflow device 300 depicted in FIGS. 3 and 4 may be referred to as a spring return plug valve. The outflow device 300 includes a diaphragm 302, a return spring 304, a valve plug 305, and a shaft 312 connecting the diaphragm 302 to the plug 305, all of which are enclosed in a valve body 310. The return spring 304 is preferably wound around a portion of the shaft 312 and connects the diaphragm 302 to a portion of the valve body 310. The shaft 312 extends from the plug 305 at one end to the diaphragm 302 at the other end through an appropriately sized, preferably cylindrically-shaped aperture in the valve body 310. The outflow device 300 also includes a fluid chamber 301 defined by a cap 309, the valve body 310, and the diaphragm 302, and a dry chamber 303 defined by the valve body 310 and the diaphragm 302. Thus, the diaphragm 302 separates the fluid and dry chambers 301, 303. The spring 304 is connected between a wall 307 of the dry chamber 303 and a surface of the diaphragm 302. The cap 309 includes an aperture through which tube 136 is inserted and secured preferably via a hose or tube fitting 311. In operation, tube 136 supplies fluid pressure to the outflow device 300.

During normal, non-cleaning operation of the water retaining device 150, the outflow device 300 is normally open with no pressure being supplied to the diaphragm 302 by tube 136. Since no pressure is supplied to the diaphragm 302, the spring 304 remains fully extended and the plug 305 remains separated from its valve seat 306. During normal operation, fluid can flow in any direction through the valve, from inlet 124 to outlet 125 and vice versa.

During the cleaning process, the rush of diluted cleaning solution into T-fitting 134 increases the fluid pressure in tube 136. Such increase in pressure in tube 136 causes an increase in pressure in the fluid chamber 301, which in turn causes the diaphragm 302 to push against the spring 304 and the shaft 312, thereby compressing the spring 304 and urging the shaft 312 toward the valve seat 306 such that the plug 305 engages and seats into the valve seat 306. When the plug 305 is seated in the valve seat 306, the outflow device 111 is closed and fluid flow through the outflow device 111 is stopped in both directions, thereby facilitating cleaning of the water retaining device's components with a minimum amount of cleaning solution supplied by the tank 104. The closed configuration of the outflow device 300 is depicted in FIG. 4.

When supply valve 107 is closed and fluid pressure is removed from the water retaining device's piping, the pressure in tube 136 drops. Responsive to such drop in pressure, the valve spring 304 returns to its filly extended position urging the diaphragm 302 back toward tube 136 and into its normally open position. Such movement of the diaphragm 302 causes the shaft 312 to disengage or remove the plug 305 from the valve seat 306, thereby opening the outflow device 300. Once the outflow device 300 has been opened (as depicted in FIG. 3), fluid is free to flow through the valve body 310 in either direction.

Figure 5:
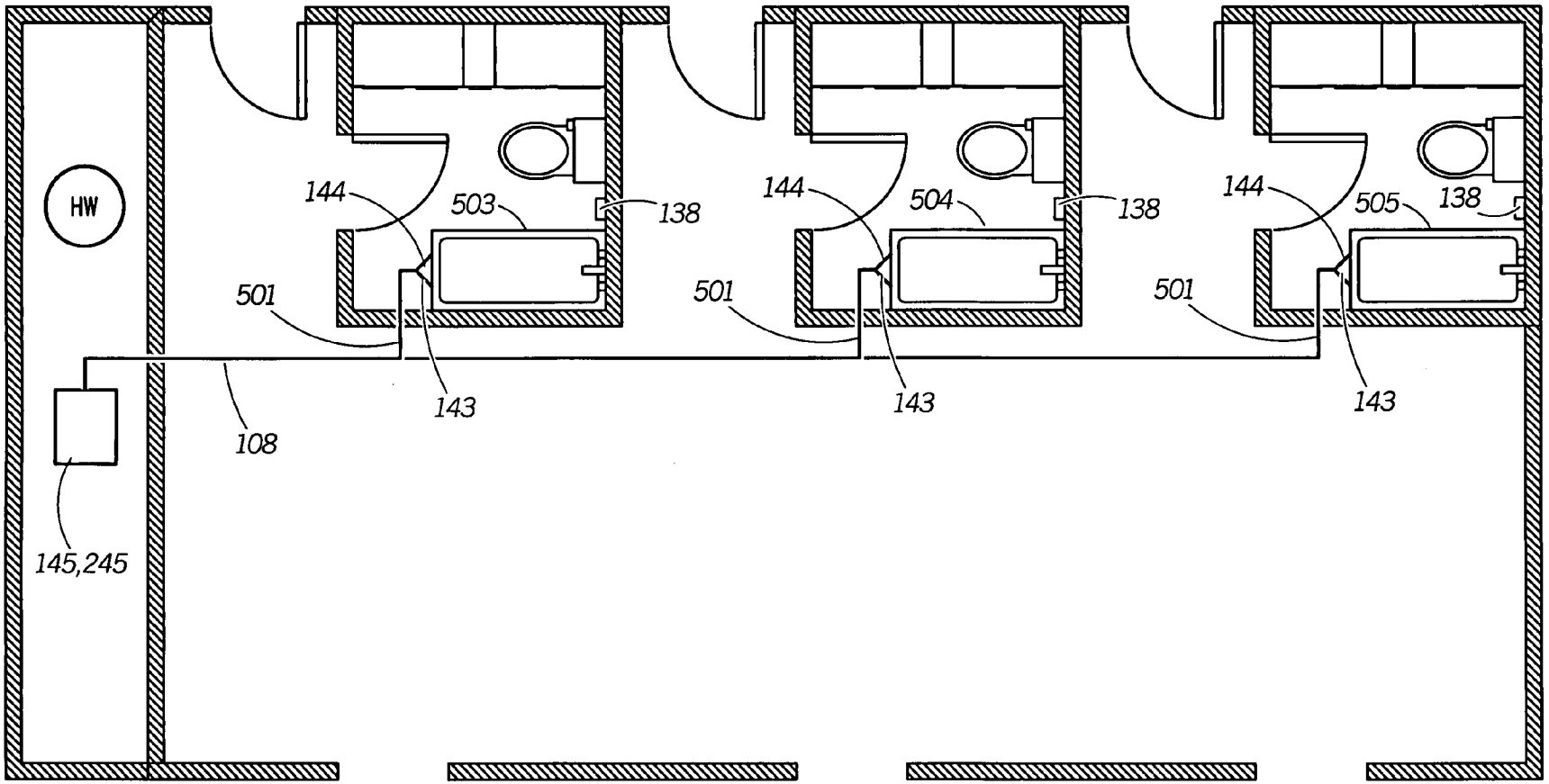
FIG. 5 is a block diagram of a system for cleaning multiple water retaining devices in accordance with the present invention.

FIG. 5 is a block diagram of multiple water retaining devices 503–505 (three shown) and their associated cleaning system in accordance with an exemplary embodiment of the present invention. In this embodiment, each water retaining device 503–505 is substantially similar to the water retaining device 150 of FIG. 1 or FIG. 2, except possibly for the physical arrangement of the seats, armrests, and other ergonomic features of the device 503–505, the quantity of air and/or water jets used in the device 503–505, and/or the size/volume of the device 503–505. The cleaning system used for a multiple tub installation is preferably either the cleaning system 100 described above with respect to FIG. 1 or the cleaning system 200 described above with respect to FIG. 2, with the exception that the multi-tub cleaning system 200 includes the supply valves and outflow devices of all the water retaining devices 503–505 and further includes a manifold coupled between the tank 104 and the supply valves to control the flow of cleaning solution to the supply valves. In the multi-tub embodiment, pipe 108 acts as a manifold to supply pressurized disinfecting solution to the individual water retaining devices 503–505. The water retaining devices 503–505 may be cleaned one at a time or simultaneously depending on the volume and pressure of the tank 104 and the programming of the control system 109.

In the multi-tub system, pipe 108 preferably extends through the building structure in accordance with local building codes. Pipe 501 tees off of pipe 108 and acts as the source line for providing diluted cleaning solution to each individual water retaining device 503–505. An isolation valve (not shown) is preferably installed in pipe 501 for maintenance purposes. During normal operation of the water retaining devices 503–505, each device's respective supply valves 106, 107 are closed, thereby preventing back flow of water into the building piping. During cleaning, the supply valves are opened to allow a flow of cleaning solution into the air and/or water subsystem components of the water retaining devices 503–505.

The control system logic is preferably arranged or programmed to detect use of each water retaining device 503–505 (e.g., through detecting activity, such as current drain, of the tub's water pump 126 or air blower or through detecting water usage, such as via a mass sensor) and indicate such use by illuminating an LED or light bulb on the control panel 138 located near (e.g., in the same room as) the water retaining device 503–505. Illumination of a light on the control panel 138 informs housekeeping personnel or other users of the cleaning system that the water retaining device 503–505 is in need of cleaning.

In a preferred embodiment, when tub cleaning is necessary, the user of the cleaning system initiates cleaning of a particular water retaining device (e.g., device 503) through use of a key switch or other appropriate mechanism forming part of the control panel 138 positioned near the device 503. Upon detecting that the key switch has been configured to initiate a cleaning cycle for a particular water retaining device 503, the control system 109 first confirms that no other cleaning cycle is in process, or that no more than a maximum number of cleaning cycles are in process simultaneously when the system is arranged to facilitate simultaneous cleaning of multiple water retaining devices 503–505, and then opens the supply valves 106, 107 associated with the device(s) 503 to be cleaned. If the maximum number of cleaning cycles are in process, the control system 109 preferably queues the cleaning request and notifies the requester through, for example, illumination of another LED or light, flashing of the "cleaning needed" light, or in any other manner. Once permitted by the control system 109, cleaning of the water retaining device 503 occurs substantially as described above with respect to FIGS. 1 and 2. After the cleaning cycle has been completed, the control system 109 turns off the "cleaning needed" indicator to inform the system user that the water retaining device 503 has been cleaned and is ready for use.

In an alternative embodiment, the cleaning cycle for each water retaining device 503–505 may be automated by the control system 109, without requiring a manual request via a key switch or other mechanism. In this case, the control system 109 monitors use of the water retaining devices 503–505 as described above. Each device 503–505 used during a predetermined time period (e.g., 24 hours) is then cleaned in a round robin or other manner after use has been completed. The tank 104 is preferably recharged after each cleaning cycle or after a predetermined number of cleaning cycles depending on the configuration of the tank 104 and other elements of the cleaning solution subsystem 145, 245. In the event that the cleaning solution subsystem 145, 245 is sized to accommodate a predetermined number of simultaneously running cleaning cycles, the predetermined number of cycles are run to clean the corresponding number of water retaining devices 503–505. The tank 104 is then recharged after completion of the predetermined number of cleaning cycles. Devices 503–505 that were not used during the applicable time period are preferably excluded from any cleaning cycle to minimize use of water and concentrated cleaning agent.

Figure 6:
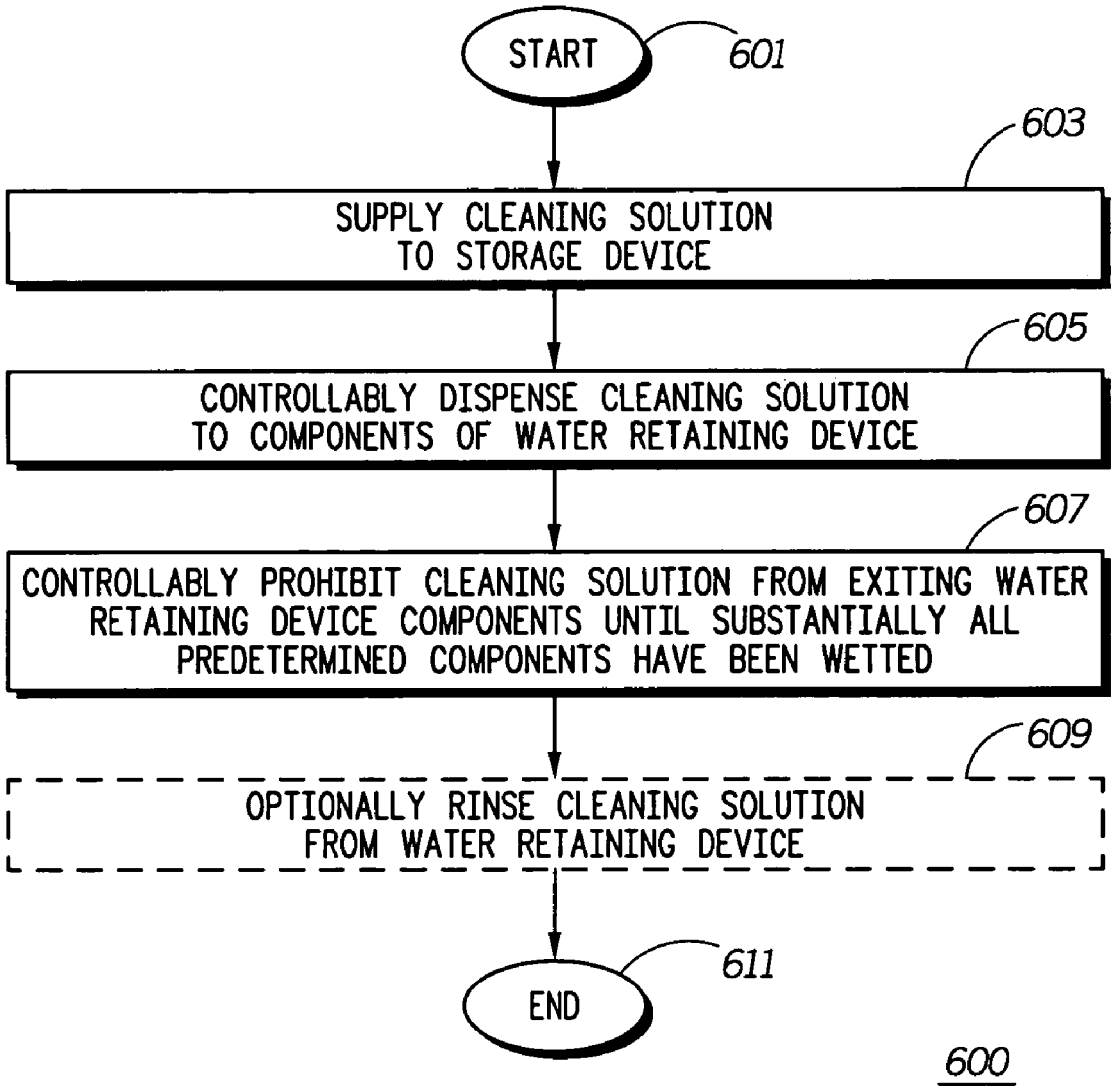
FIG. 6 is a flow chart of steps executed to clean one or more water retaining devices in accordance with the present invention.

FIG. 6 is a flow chart 600 of steps executed to clean one or more water retaining devices in accordance with the present invention. The cleaning flow begins (601) when a cleaning solution is supplied (603) to a storage device (e.g., reservoir) located remotely from the water retaining device (s). The cleaning solution preferably comprises a non-hazardous, concentrated agent, such as antibacterial soap or bleach. Alternatively, the cleaning solution may comprise a pre-diluted solution.

Once supplied, the cleaning solution is controllably dispensed (605) or released from the storage device to components (e.g., air and/or water subsystem components) of the water retaining device(s). When the cleaning solution is a concentrated agent, such solution is preferably mixed with an appropriate amount of water to produce a desired diluted solution. The release of the cleaning solution from the storage device is preferably controlled by an electronic or electromechanical control system that opens and closes, as applicable, an output valve of the storage device and/or input, supply valves of the water retaining device(s).

In addition to being controllably dispensed from the storage device, the cleaning solution is controllably prohibited (607) from exiting the components of the water retaining device until all or substantially all the components of the water retaining device have been wetted by the cleaning solution. Control of the cleaning solution's exit from the water retaining device components is preferably performed by an outflow device (e.g., the outflow device 111 described above with respect to FIGS. 1–4) positioned in the drain or suction opening of the water retaining device. Thus, while the cleaning solution is being dispensed from the storage device, the cleaning solution is preferably prevented from exiting the water retaining device's piping system, thereby facilitating the use of a minimum amount of cleaning solution to effectuate the cleaning and reducing the amount of time required to wet all or substantially all of the wetted components of the water retaining device.

After the solution has been completely injected into the components of the water retaining device, the drain or suction opening of the device is opened and the cleaning solution is allowed to drain out of the water retaining device's piping. The cleaning solution may be optionally rinsed (609) out of the water retaining device by controllably supplying hot or cold water through the device's piping, although retention of residual amounts of the cleaning solution in the device's piping is desirable to deter or prevent the growth of bacteria therein. After the cleaning solution has drained or been optionally rinsed from the water retaining device, the cleaning flow ends (611).

Figure 7:
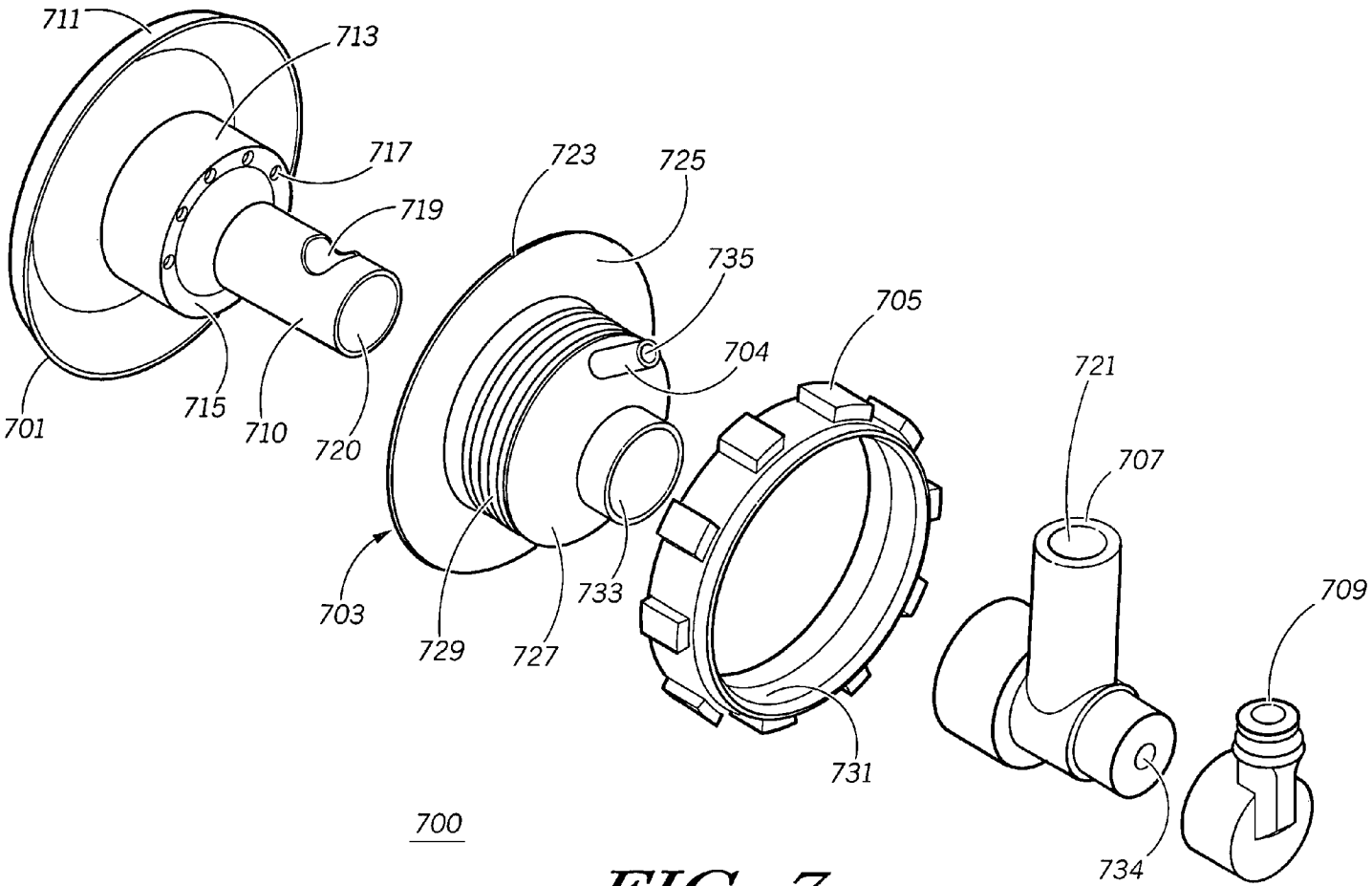
FIG. 7 is an exploded, perspective view of a water propulsion device in accordance with an alternative embodiment of the present invention.

FIG. 7 is an exploded, perspective view of a water propulsion device 700 in accordance with an alternative embodiment of the present invention. The water propulsion device 700 is preferably used to implement the air and/or water jets 117–122, 128, 129 in the water retaining devices 150, 503–505 and cleaning systems 100, 200 depicted in FIGS. 1, 2 and 5. As a result, the water propulsion device 700 is preferably an air and/or water subsystem component of the water retaining devices 150, 503–505 and preferably forms part of the cleaning systems 100, 200.

Figure 8:
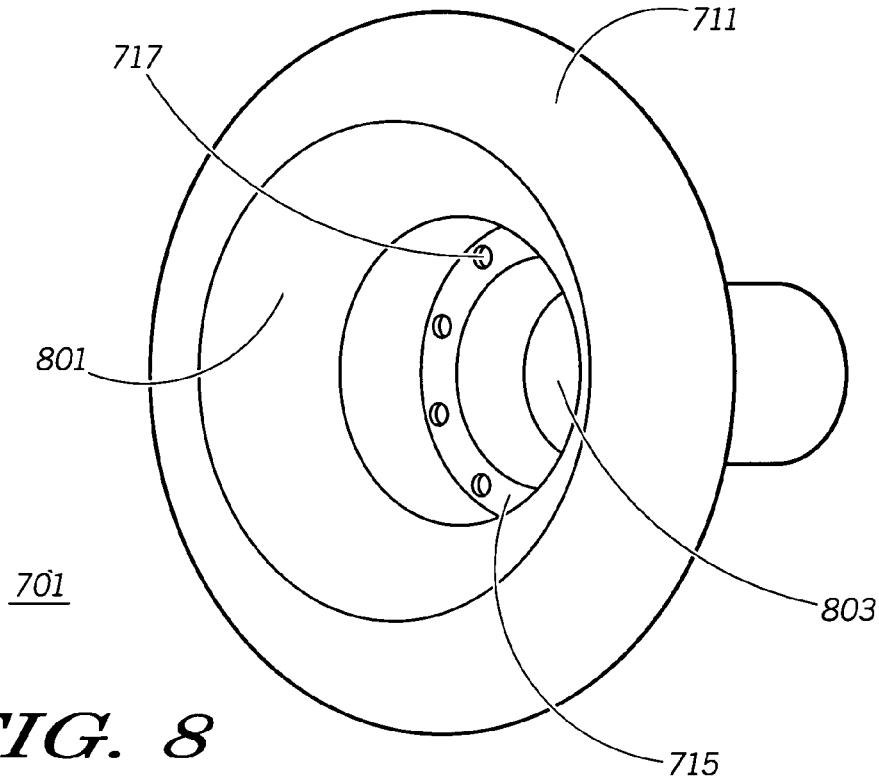
FIG. 8 is a perspective view of a face or cover of the water propulsion device of FIG. 7.
Figure 9:
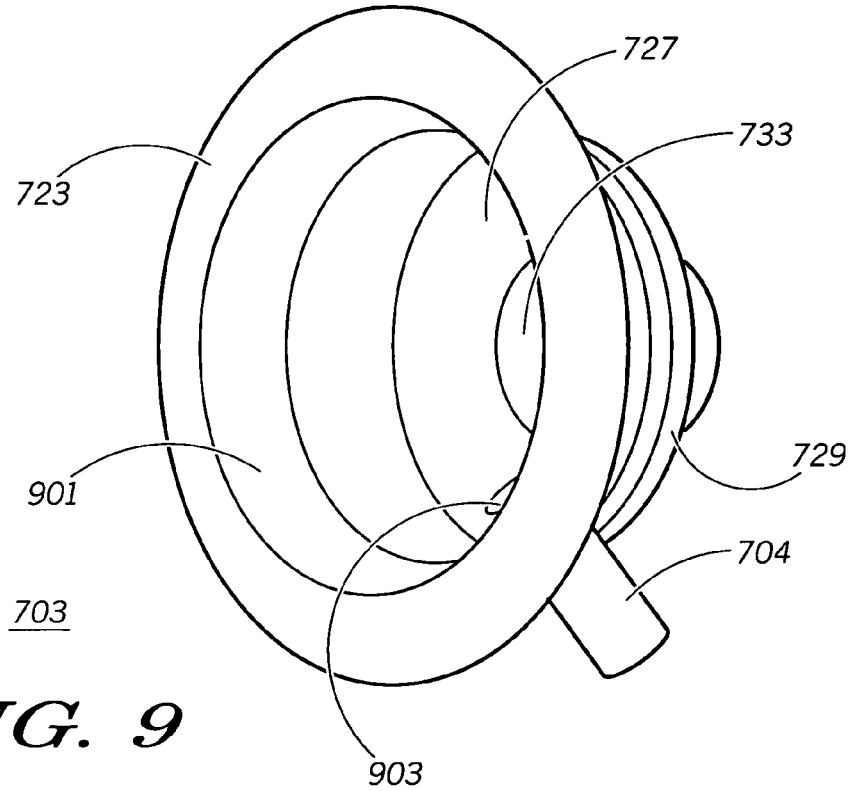
FIG. 9 is a perspective view of a body of the water propulsion device of FIG. 7.

As illustrated in FIG. 7, the water propulsion device 700 preferably includes a face or cover 701, a body 703, a cleaning solution inlet 704, a nut 705, a stepped tee connector 707, a right angle connector 709, and a nozzle 710. Additional perspective views of the cover 701 and the body 703 are illustrated in FIGS. 8 and 9, respectively.

The cover 701 preferably includes a recessed interior surface 801 (shown in FIG. 8), a flared or flanged surface 711 surrounding the interior surface 801, an exterior surface 713, and a base 715. The base 715 of the cover 701 defines one or more apertures 717 (five shown) to facilitate a flow of cleaning solution onto the interior surface 801 of the cover 710 and an exterior surface 1001 of the nozzle 710 (shown in FIG. 10). The aperture(s) 717 may be any shape, but are depicted as being circular in FIGS. 7 and 8.

Figure 10:
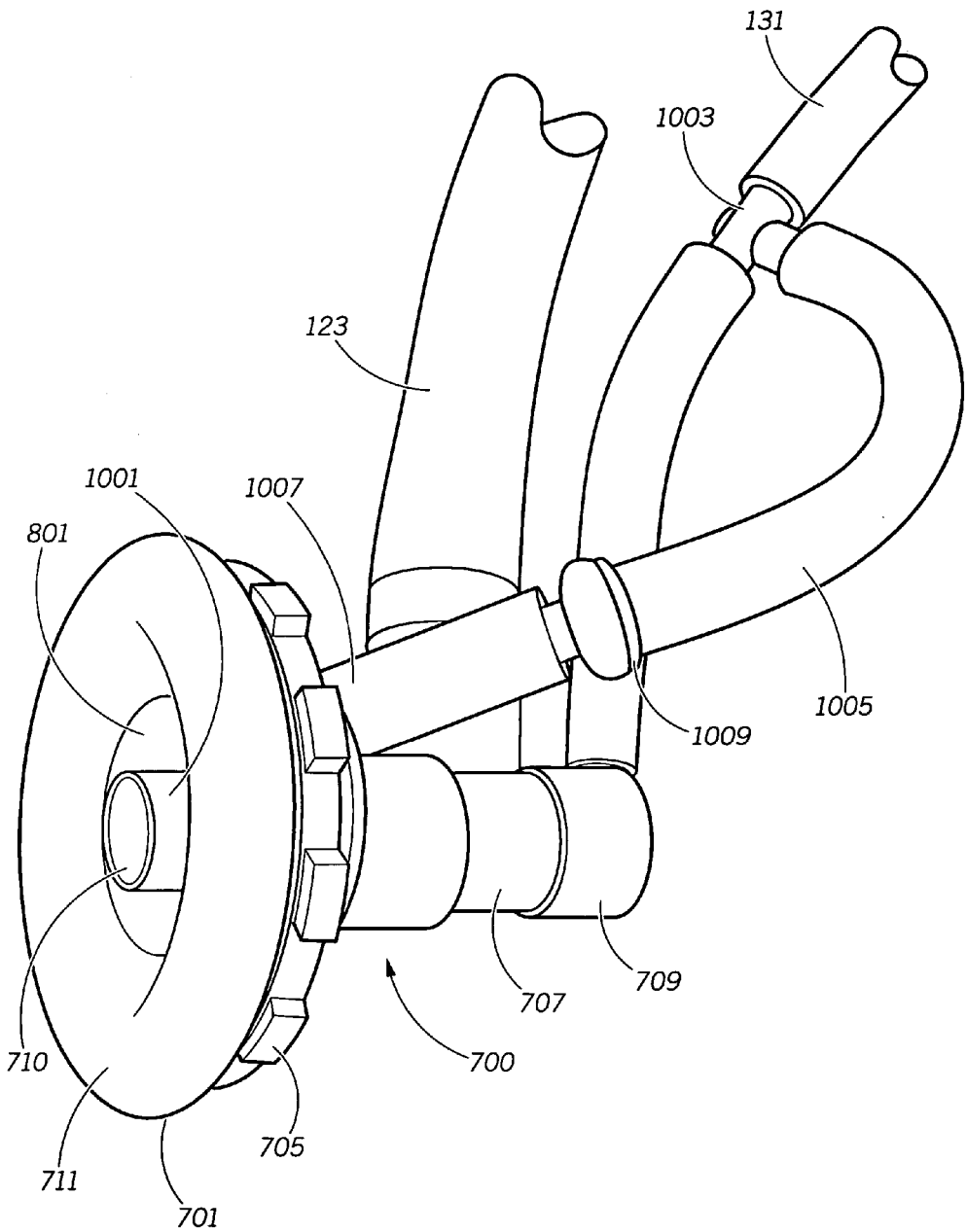
FIG. 10 is a perspective view of the water propulsion device of FIG. 7 in assembled form together with its associated tubing, valve, and fittings in accordance with a preferred embodiment of the present invention.

The cover 701 also defines a centrally located aperture 803 (depicted in FIG. 8) into which the nozzle 710 is inserted and through which water supplied from the tee connector 707 flows during operation of the water retaining device 150. The nozzle 710 defines a first aperture 719 that substantially aligns with a cylindrical aperture 721 in one branch of the tee connector 707 when the water propulsion device 700 is assembled. The nozzle 710 also defines a second aperture 720 that substantially aligns with a second aperture 734 in the tee connector 707 to facilitate a flow of air from an air source, such as an air line 131 as illustrated in FIG. 10, into the water supplied via the cylindrical aperture 721 of the tee connector 707. The cover 701 and the nozzle 710 are preferably made of plastic (e.g., PVC or acrylonitrile-butadiene-styrene (ABS)) in accordance with conventional techniques, except that the base 715 of the cover 701 includes one or more apertures 717 to facilitate conveyance of cleaning solution onto the interior surface of the cover 701 and the exterior surface of the nozzle 710. The base apertures 717 may be drilled after the cover 701 is fabricated or may be integrally fabricated with the cover 701 using conventional molding techniques.

The base apertures 717 are preferably arranged and angled to facilitate a desired wetting of the interior surface 801 of the cover 701 and the exterior surface 1001 of the nozzle 710. In addition, multiple apertures 717 are preferably placed around the periphery of the cover's base 715 to accommodate the rotating action typical of some conventional jets to increase and decrease water and/or air flow during normal operation of the water retaining device 150. By using multiple apertures 717, the cover 701 of the water propulsion device 700 need not be rotated to a particular position to facilitate a desired distribution of cleaning solution during a cleaning cycle.

Like the cover 701, the body 703 of the water propulsion device 700 preferably includes a recessed interior surface 901 (shown in FIG. 9), a flared or flanged surface 723 surrounding the interior surface 901, an exterior surface 725, and a base 727. The exterior surface 725 of the body 703 preferably defines a series of ridges or threads 729 that mate with a complementary series of ridges or threads on an interior surface 731 of the nut 705 when the nut 705 is secured to the body 703. The base 727 of the body 703 defines one or more apertures 903 (one shown in FIG. 9) to facilitate a flow of cleaning solution onto the interior and exterior surfaces 801, 713 of the cover 701 and the interior surface 901 and the flanged surface 723 of the body 703.

The body 703 also defines a centrally located aperture 733 through which the nozzle 710 is inserted and through which water supplied from the tee connector 707 flows during operation of the water retaining device 150. The aperture 733 positioned in the central portion of the body 703 aligns substantially with the aperture 803 positioned in the central portion of the cover 701 when the cover 701 and the body 703 are mated together and preferably secured to the wall of the water retaining device 150 by the nut 705. The recessed interior surface 901 of the body 703 is configured (e.g., shaped) to accommodate the exterior surface 713 of the cover 701 when the cover 701 and the body 703 are mated together in an inter-fitting relation. In addition, the flanged surface 723 of the body 703 is preferably curved or otherwise configured to generally mate with the underside of the flanged portion 711 of the cover, thereby allowing the body 703 to mate securely with the cover 701 upon assembly. However, while the general physical configuration of the body 703 preferably accommodates, mates with, and/or conforms to the general physical configuration of the cover 701 such that, when the cover 701 and the body 703 are mated together, the exterior surface 713 of the cover 701 resides in close proximity to, but does not touch, the interior surface 901 of the body 703, such conforming physical configurations of the cover 701 and the body 703 are not critical to the operation of the water propulsion device 700 of the present invention. Rather, such preferred configurations of the cover 701 and the body 703 would reduce the amount of cleaning solution necessary to clean the various surfaces 713, 723, 801, 901, 903 of the body 703 and the cover 701.

The cleaning solution inlet 704 defines a cylindrical aperture 735 and is connected to the exterior surface of the base 727 of the body 703 such that the inlet's aperture 735 substantially aligns with the cleaning solution aperture 903 in the base 727 of the body 703. The inlet 704 provides a conduit for cleaning solution supplied during a cleaning cycle to enter and wet the various surfaces 713, 723, 801, 901, 903, 1001 of the water propulsion device 700. The body 703 and the cleaning solution inlet 704 are preferably fabricated from plastic, such as PVC or ABS, and the inlet 704 preferably forms an integral part of the exterior of the body 703. For example, the inlet 704 may be fabricated as a hose bib boss or other part of the body 703 using conventional injection molding techniques.

In an alternative embodiment, the cleaning solution inlet 704 may be molded or glued to the base 727 of the body 703 without an aperture 735 therein and/or without a cleaning solution aperture 903 in the base 727 of the water propulsion device's body 703, thereby permitting the water propulsion device 700 to be used in a water retaining device that has not been incorporated into an automated cleaning system 100, 200. In such a case, if the water propulsion device 700 and/or its associated water retaining device 150 were later included in such a cleaning system 100, 200, the cover 701 of the water propulsion device 700 could be removed and the apertures 735, 903 in the inlet 704 and the base 727 of the body 703 could be formed using a drill having a drill bit appropriately sized to fit the inside diameter of the inlet 704 or using any other conventional means for hollowing out the inlet 704 and creating the aperture 903 in the propulsion device's body 703.

The nut 705, the tee connector 707 and the right angle connector 709 are conventional elements commonly used in fabricating jets for use in hydrotherapy tubs. All three components 705, 707, 709 are preferably PVC, ABS or other comparable plastic components. The tee connector 707 is preferably connected to the base 727 of the body 703 using an appropriate glue. Similarly, the right angle connector 709 is preferably secured to the tee connector 707 with the same or another appropriate glue.

Interconnection of the water propulsion device 700 into the water retaining device 150 and the cleaning system 100, 200 may be best understood with reference to FIGS. 7 and 10. To assemble the water propulsion device 700, the cover 701 and the body 703 are mated together and secured in a conventional manner preferably using a plastic (e.g., PVC or ABS), molded wedge clip (not shown). The bases 715, 727 of the cover 701 and the body 703 are passed through an appropriately-sized aperture in a wall of the water retaining device 150 such that the flanged portion of the exterior surface 725 of the body 703 contacts an inside surface of the wall of the water retaining device 150. In the preferred embodiment, a gasket or silicone gel or caulk is applied to the flanged portion of the exterior surface 725 of the body 703 to facilitate a water tight seal between the body 703 and the wall of the water retaining device 150. The nut 705 is then threaded onto the threads 729 of the body 703 to secure the body 703 to the wall of the water retaining device 150 such that a water tight seal is formed. The tee connector 707 is preferably glued to the base 727 of the body 703 and the right angle connector 709 is preferably glued to the tee connector 707 to complete assembly of the water propulsion device 700.

The assembled propulsion device 700 is connected to the water line or tubing 123 and the air line or tubing 131 by preferably connecting PVC or rubber tubing to the inlet branch of the tee connector 707 and to the inlet branch of the right angle connector 709, respectively. In addition, a tee fitting 1003 is preferably inserted in the air line 131 to allow some of the pressurized cleaning solution injected into the air line 131 via the air line supply valve 106 to be diverted to the cleaning solution inlet 704 of the water propulsion device 700. The tee fitting 1003 is coupled to the cleaning solution inlet 704 of the water propulsion device 700 via two tubes 1005, 1007 separated by a check valve 1009. One tube 1005 is coupled at one end to a branch of the tee fitting 1003 and at the other end to an input of the check valve 1009. The other tube 1007 is coupled at one end to an output of the check valve 1009 and at the other end to the cleaning solution inlet 704 of the water propulsion device 700.

In an alternative embodiment, the air line 131, the tee fitting 1003, the cleaning solution supply tubes 1005, 1007 and the check valve 1009 can be appropriately sized and configured to increase or decrease the flow of cleaning solution, as desired, to the water propulsion device's air passageway (including the right angle connector 709 and the tee connector 707) and the interior surfaces 711, 713, 723, 801, 901 of the water propulsion device 700. Such flow control may include the use of strategically positioned valves (not shown) in the cleaning solution supply path (e.g., between the tee fitting 1003 and the check valve 1009) and/or the water propulsion device's air passageway (e.g., between the tee fitting 1003 and the right angle connector 709) to control the volume of cleaning solution in each path.

During normal operation of the water retaining device 150, the tee connector 707 acts as a venturi, pulling air from the air line 131 into the water stream supplied through tube 123. The check valve 1009 is placed in between tube 1005 and tube 1007 to prevent the venturi from pulling water from the water line 123 rather than air from the air line 131 during normal use of the water retaining device 150. The check valve 1009 also permits the cleaning solution to pass to the water propulsion device 700 during a cleaning cycle.

During operation of a cleaning cycle, pressurized cleaning solution rushes through the air line 131 and the water line 123, wetting the interior surfaces thereof as well as the interior surfaces of the tee connector 707, the right angle connector 709, and the nozzle 710. A portion of the cleaning solution present in the air line 131 is diverted into the cleaning solution inlet 704 of the water propulsion device 700 via the tee fitting 1003, tubes 1005 and 1007, and the check valve 1009. Upon entering the aperture 735 of the inlet 704, the cleaning solution passes through the aperture 903 in the base 727 of the body 703 of the water propulsion device 700 and onto both the flanged and interior surfaces 723, 901 of the body 703 and the exterior surfaces 713 of the cover 701 of the water propulsion device 700. The cleaning solution also passes through one or more of the apertures 717 in the base 715 of the cover 701 and sprays onto the flanged and interior surfaces 711, 801 of the cover 701 and the exterior surface 1001 of the nozzle 710, preferably thoroughly wetting such surfaces 711, 801, 1001 with the cleaning solution. The cleaning solution is then allowed to drain out of the water retaining device's piping or is optionally rinsed as detailed above with respect to FIGS. 1–6. Thus, by using a water propulsion device 700 as depicted in FIGS. 7–9 and detailed above, the cleaning solution can be thoroughly applied to all or substantially all the wetted surfaces 711, 713, 723, 801, 901, 1001 of the water propulsion device 700.

As described above, the present invention encompasses a system and method for cleaning components of one or more water retaining devices, such as hydro-massage tubs or pools. With this invention, a single water retaining device, such as may be implemented in a personal residence, or several water retaining devices, such as may be embodied in a hotel or elsewhere, may be automatically and rapidly cleaned without requiring the use of potentially hazardous cleaning agents, such as ozone, or manual addition of the cleaning solution/agent in each individual device. In addition, the cleaning system and method of the present invention substantially reduce the amount of cleaning agent and water normally required for cleaning and disinfecting jetted water retaining devices. Still further, through use of the disclosed water propulsion device and its associated cleaning solution supply path, the surfaces of the water propulsion device on which bacteria is likely to grow as a result of normal operation of the water retaining device are substantially covered with cleaning solution to kill any such bacteria and/or prohibit its growth.

In the foregoing specification, the present invention has been described with reference to specific embodiments. However, one of ordinary skill in the art will appreciate that various modifications and changes may be made without departing from the spirit and scope of the present invention as set forth in the appended claims. For example, the water retaining device 150, 503–505 may include only an air subsystem or a water subsystem, but not both. In such a case, the applicable components of the omitted subsystem would accordingly be omitted from the device 150, 503–505 and associated components of the cleaning system 100, 200 would also be omitted.

In addition, while separate supply valves 106, 107 have been described for the air and water subsystem components of the water retaining device 150, one of ordinary skill in the art will readily recognize that a single supply valve may be positioned to supply cleaning solution to both such subsystems, or that multiple valves may be used to supply cleaning solution to each such subsystem. The use of a single valve to supply cleaning solution to both subsystems may result in an increase in the amount of time required to complete the cleaning cycle. The use of multiple valves to supply cleaning solution to each subsystem facilitates minimal use of cleaning solution and rapid cleaning times, but increases system complexity and cost.

Further, while outflow devices 111 have been described herein primarily with respect to closing the output suction line(s) 127 of the water retaining device(s) 150, 503–505, such devices 111 may be strategically placed at various locations of the cleaning system 100, 200 to control the flow of cleaning solution out of the water retaining device(s) 150, 503–505 and thereby facilitate minimal use of cleaning solution and rapid cleaning times. Still further, while a check valve 1009 has been described herein for use in the cleaning solution supply path to the inlet 704 of the water propulsion device 700, such valve may be replaced with any one of a variety of known electrically controlled valves, mechanically controlled valves, pneumatically controlled valves, or hydraulically controlled valves. Accordingly, the specification and drawings are to be regarded in an illustrative rather than a restrictive sense, and all such modifications are intended to be included within the scope of the present invention.

Benefits, other advantages, and solutions to problems have been described above with regard to specific embodiments of the present invention. However, the benefits, advantages, solutions to problems, and any element(s) that may cause or result in such benefits, advantages, or solutions to become more pronounced are not to be construed as a critical, required, or essential feature or element of any or all the claims. As used herein and in the appended claims, the terms "comprises," "comprising" or any other variation thereof is intended to refer to a non-exclusive inclusion, such that a process, method, apparatus, or article of manufacture that comprises a list of elements does not include only those elements in the list, but may include other elements not expressly listed or inherent to such process, method, apparatus, or article of manufacture.

I claim:

1. An automated system for cleaning components of one or more water retaining devices, the system comprising:

a first pump for controlling a flow of a cleaning agent from a source of the cleaning agent;

a second pump for controlling a flow of water from a water source;

a tank, coupled to the first pump and the second pump, for receiving the water from the first pump and the cleaning agent from the second pump to produce a diluted solution, and selectively dispensing the diluted solution at a desired pressure;

a water retaining device that includes a plurality of components, the plurality of components including at least one water propulsion device, said water propulsion device including:

a cover that includes a recessed interior surface terminating in a base, the base defining at least one aperture around a periphery thereof and further defining a water supply aperture positioned in a central portion thereof;

a body that includes a recessed interior surface that accommodates an exterior surface of the cover when the body and the cover are mated together in an inter-fitting relation, the body terminating in a base that defines a water supply aperture positioned in a central portion thereof and substantially aligned with the water supply aperture in the base of the cover when the body and the cover are mated together, the base of the body further defining an inlet aperture to facilitate a flow of the diluted solution to surfaces of the cover and the body and to the at least one aperture in the periphery of the base of the cover to facilitate cleaning of at least the interior and exterior surfaces of the cover and the interior surface of the body; and an inlet connected to an exterior surface of the base of the body, the inlet defining an aperture to facilitate the flow of the diluted solution to the inlet aperture in the base of the body, the inlet being positioned such that the aperture of the inlet substantially aligns with the inlet aperture of the base of the body;

at least one supply valve, coupled between the tank and the water retaining device, for controlling a flow of the diluted solution to the water retaining device; and control circuitry that controls operation of at least the first pump and the second pump in accordance with a procedure for cleaning the plurality of components of the water retaining device.

2. The system of claim 1, wherein the first pump and the second pump are configured to provide the tank a predetermined ratio of the cleaning agent to the water to produce the diluted solution.

3. The system of claim 1, wherein the control circuitry includes a pressure switch that detects a pressure in the tank, stops the flow of the water and the cleaning agent to the tank when the pressure in the tank reaches a first threshold, and activates the flow of the water and the cleaning agent to the tank when the pressure in the tank reaches a second threshold, the second threshold being substantially less than the first threshold.

4. The system of claim 1, wherein the plurality of components of the water retaining device include air system components and water system components and wherein the at least one supply valve comprises a first supply valve coupled between the tank and the air system components of the water retaining device and a second supply valve coupled between the tank and water system components of the water retaining device.

5. The system of claim 1, further comprising at least one outflow device, coupled to at least one suction output of the water retaining device, for controlling a flow of the diluted solution out of the plurality of components of the water retaining device in accordance with the procedure for cleaning the components of the water retaining device.

6. The system of claim 5, wherein the plurality of components of the water retaining device include air system components and water system components, the system further comprising:

a tee fitting, coupled between the at least one supply valve and the water system components of the water retaining device, to divide the diluted solution among at least some of the water system components; and a tube coupled to the tee fitting to supply fluid pressure to the at least one outflow device;

wherein the outflow device includes:

a valve seat;

a plug normally separated from the valve seat;

a shaft coupled at a first end to the plug;

a valve body defining a first chamber and a second chamber;

a spring positioned within the second chamber and about a portion of the shaft, the spring being coupled at a first end to a wall of the second chamber; and a diaphragm separating the first chamber from the second chamber and being coupled to a second end of the shaft and to a second end of the spring, wherein fluid pressure supplied from the tube causes the diaphragm to compress the spring and urge the shaft toward the valve seat such that the plug engages the valve seat and closes the outflow device, and wherein removal of fluid pressure from the tube allows the spring to extend and urge the diaphragm toward the tube such that the shaft disengages the plug from the valve seat to open the outflow device.

7. The system of claim 5, wherein the outflow device controls the flow of diluted solution out of the plurality of components of the water retaining device at a rate that is slower than a rate at which the at least one supply valve controls the flow of diluted solution to the plurality of components of the water retaining device.

8. The system of claim 1, wherein the first pump comprises an automotive fuel pump.

9. The system of claim 8, further comprising an automotive fuel injector positioned between the first pump and the tank.

10. The system of claim 1, wherein the control circuitry further controls the at least one supply valve in accordance with the procedure for cleaning the plurality of components of the water retaining device.

11. The system of claim 1, wherein the control circuitry includes a control panel arranged to inform a user of the system that the water retaining device requires cleaning.

12. The system of claim 1, wherein the water retaining device further includes:

a first tube coupled at a first end to the inlet of the water propulsion device;

a check valve coupled at a first end to a second end of the first tube;

a second tube coupled to a second end of the check valve; and a tee fitting coupled between an air line and the second tube to facilitate a flow of the diluted solution to the inlet of the water propulsion device via the second tube, the check valve, and the first tube.

13. A system for cleaning components of a water retaining device, the system comprising:

a pump for controlling a flow of cleaning solution from a source of the cleaning solution;

a tank, coupled to the pump, for receiving, storing, and selectively dispensing the cleaning solution at a desired system pressure;

a water retaining device that includes a plurality of components, the plurality of components including at least one water propulsion device, said water propulsion device including:

a cover that includes a recessed interior surface terminating in a base, the base defining at least one aperture around a periphery thereof and further defining a water supply aperture positioned in a central portion thereof;

a body that includes a recessed interior surface that accommodates an exterior surface of the cover when the body and the cover are mated together in an inter-fitting relation, the body terminating in a base that defines a water supply aperture positioned in a central portion thereof and substantially aligned with the water supply aperture in the base of the cover when the body and the cover are mated together, the base of the body further defining an inlet aperture to facilitate a flow of the cleaning solution to surfaces of the cover and the body and to the at least one aperture in the periphery of the base of the cover to facilitate cleaning of at least the interior and exterior surfaces of the cover and the interior surface of the body; and an inlet connected to an exterior surface of the base of the body, the inlet defining an aperture to facilitate the flow of the cleaning solution to the inlet aperture in the base of the body, the inlet being positioned such that the aperture of the inlet substantially aligns with the inlet aperture of the base of the body;

at least one supply valve, coupled between the tank and the water retaining device, for controlling a flow of the cleaning solution to the water retaining device; and control circuitry that controls operation of at least the pump and the supply valve in accordance with a procedure for cleaning the plurality of components of the water retaining device.

14. A system for cleaning multiple water retaining devices, the system comprising:

a first pump for controlling a flow of a cleaning agent from a source of the cleaning agent;

a second pump for controlling a flow of water from a water source;

a tank, coupled to the first pump and the second pump, for receiving the water from the first pump and the cleaning agent from the second pump to produce a diluted solution, and selectively dispensing the diluted solution at a desired pressure;

a plurality of water retaining devices, each of the plurality of water retaining devices including a plurality of components, the plurality of components including at least one water propulsion device, said water propulsion device including:

a cover that includes a recessed interior surface terminating in a base, the base defining at least one aperture around a periphery thereof and further defining a water supply aperture positioned in a central portion thereof;

a body that includes a recessed interior surface that accommodates an exterior surface of the cover when the body and the cover are mated together in an inter-fitting relation, the body terminating in a base that defines a water supply aperture positioned in a central portion thereof and substantially aligned with the water supply aperture in the base of the cover when the body and the cover are mated together, the base of the body further defining an inlet aperture to facilitate a flow of the diluted solution to surfaces of the cover and the body and to the at least one aperture in the periphery of the base of the cover to facilitate cleaning of at least the interior and exterior surfaces of the cover and the interior surface of the body; and an inlet connected to an exterior surface of the base of the body, the inlet defining an aperture to facilitate the flow of the diluted solution to the inlet aperture in the base of the body, the inlet being positioned such that the aperture of the inlet substantially aligns with the inlet aperture of the base of the body;

a plurality of supply valves coupled between the tank and the plurality of water retaining devices for controlling a flow of the diluted solution to the plurality of water retaining devices; and control circuitry that controls the operation of at least the first pump and the second pump in accordance with a procedure for cleaning the plurality of water retaining devices.

15. The system of claim 14, further comprising a plurality of outflow devices coupled to suction outputs of the plurality of water retaining devices for controlling a flow of the diluted solution out of the plurality of components of the plurality of water retaining devices in accordance with the procedure for cleaning the plurality of water retaining devices.

16. The system of claim 14, further comprising a manifold, coupled between the tank and the plurality of supply valves, for controlling the flow of the diluted solution to the plurality of supply valves.

17. The system of claim 14, wherein the control circuitry controls the flow of the diluted solution to the plurality of supply valves such that the plurality of water retaining devices are cleaned one at a time.

18. A water retaining device that includes components requiring occasional cleaning, the water retaining device comprising:

at least one supply valve that controls a flow of cleaning solution from a remote source of the cleaning solution to the components of the water retaining device;

at least one outflow valve, coupled to a suction output of the water retaining device, for controlling a flow of the cleaning solution out of the components of the water retaining device, wherein the at least one outflow valve controls the flow of cleaning solution out of the components of the water retaining device at a rate that is slower than a rate at which the at least one supply valve controls the flow of cleaning solution to the components of the water retaining device; and at least one water propulsion device coupled to the at least one supply valve, the water propulsion device including:

a cover that includes a recessed interior surface terminating in a base, the base defining at least one aperture around a periphery thereof and further defining a water supply aperture positioned in a central portion thereof;

a body that includes a recessed interior surface that accommodates an exterior surface of the cover when the body and the cover are mated together in an inter-fitting relation, the body terminating in a base that defines a water supply aperture positioned in a central portion thereof and substantially aligned with the water supply aperture in the base of the cover when the body and the cover are mated together, the base of the body further defining an inlet aperture to facilitate a flow of the cleaning solution to surfaces of the cover and the body and to the at least one aperture in the periphery of the base of the cover to facilitate cleaning of at least the interior and exterior surfaces of the cover and the interior surface of the body; and an inlet connected to an exterior surface of the base of the body, the inlet defining an aperture to facilitate the flow of the cleaning solution to the inlet aperture in the base of the body, the inlet being positioned such that the aperture of the inlet substantially aligns with the inlet aperture of the base of the body.

19. The water retaining device of claim 18, wherein the components of the water retaining device include water system components, the water retaining device further comprising:

a tee fitting, coupled between the at least one supply valve and the water system components, to divide the cleaning solution among at least some of the water system components; and a tube coupled to the tee fitting to supply fluid pressure to the at least one outflow valve;

wherein the outflow valve includes:

a valve seat;

a plug normally separated from the valve seat;

a shaft coupled at a first end to the plug;

a valve body defining a first chamber and a second chamber;

a spring positioned within the second chamber and about a portion of the shaft, the spring being coupled at a first end to a wall of the second chamber; and a diaphragm separating the first chamber from the second chamber and being coupled to a second end of the shaft and to a second end of the spring, wherein fluid pressure supplied from the tube causes the diaphragm to compress the spring and urge the shaft toward the valve seat such that the plug engages the valve seat and closes the outflow valve, and wherein removal of fluid pressure from the tube allows the spring to extend and urge the diaphragm toward the tube such that the shaft disengages the plug from the valve seat to open the outflow valve.

20. The water retaining device of claim 18, further comprising:

a first tube coupled at a first end to the inlet of the water propulsion device;

a check valve coupled at a first end to a second end of the first tube;

a second tube coupled to a second end of the check valve; and a tee fitting coupled between an air line and the second tube to facilitate a flow of the cleaning solution to the inlet of the water propulsion device via the second tube, the check valve, and the first tube.

21. A water propulsion device for use in a water retaining device that receives cleaning solution in accordance with an automated cleaning procedure, the water propulsion device comprising:

a cover that includes a recessed interior surface terminating in a base, the base defining at least one aperture around a periphery thereof and further defining a water supply aperture positioned in a central portion thereof;

a body that includes a recessed interior surface that accommodates an exterior surface of the cover when the body and the cover are mated together in an inter-fitting relation, the body terminating in a base that defines a water supply aperture positioned in a central portion thereof and substantially aligned with the water supply aperture in the base of the cover when the body and the cover are mated together, the base of the body further defining an inlet aperture to facilitate a flow of the cleaning solution to surfaces of the cover and the body and to the at least one aperture in the periphery of the base of the cover to facilitate cleaning of at least the interior and exterior surfaces of the cover and the interior surface of the body; and an inlet connected to an exterior surface of the base of the body, the inlet defining an aperture to facilitate the flow of the cleaning solution to the inlet aperture in the base of the body, the inlet being positioned such that the aperture of the inlet substantially aligns with the inlet aperture of the base of the body.

* * * * *